US008278805B2

(12) United States Patent
Monteix

(10) Patent No.: US 8,278,805 B2
(45) Date of Patent: Oct. 2, 2012

(54) LAMP ASSEMBLY WITH LAMP AND REFLECTOR

(75) Inventor: Serge Monteix, Pont a Mousso (FR)

(73) Assignee: Speziallampenfabrik Dr. Fischer GmbH, Diez (DE)

( * ) Notice: Subject to any disclaimer, the term of this patent is extended or adjusted under 35 U.S.C. 154(b) by 381 days.

(21) Appl. No.: 11/575,148

(22) PCT Filed: Sep. 12, 2005

(86) PCT No.: PCT/IB2005/052975

§ 371 (c)(1),
(2), (4) Date: Mar. 13, 2007

(87) PCT Pub. No.: WO2006/030370

PCT Pub. Date: Mar. 23, 2006

(65) Prior Publication Data

US 2008/0315744 A1 Dec. 25, 2008

(30) Foreign Application Priority Data

Sep. 16, 2004 (EP) ..... 04300603

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/113; 313/318.07; 392/422

(58) Field of Classification Search ..... 313/113, 313/318.09, 318.1, 318.11, 318.07; 392/407, 392/418, 419, 422; 219/685, 452.11, 455.12, 219/451.1, 455.11

See application file for complete search history.

(56) References Cited

U.S. PATENT DOCUMENTS

| | | | | | |
|---|---|---|---|---|---|
| 2,705,310 | A | * | 3/1955 | Hodge | 439/612 |
| 3,037,139 | A | * | 5/1962 | Myers | 313/113 |
| 3,179,789 | A | | 4/1965 | Gialanella | |
| 3,355,574 | A | * | 11/1967 | Bassett, Jr. | 219/452.11 |
| 3,436,524 | A | * | 4/1969 | Pauls | 392/411 |
| 3,441,778 | A | * | 4/1969 | Deiss | 313/318.07 |
| 3,961,216 | A | * | 6/1976 | Edwards | 313/51 |
| 4,322,783 | A | * | 3/1982 | Chappell et al. | 362/217.12 |
| 4,551,616 | A | * | 11/1985 | Buttery | 219/452.12 |
| 4,556,786 | A | * | 12/1985 | Frost et al. | 219/459.1 |
| 4,598,194 | A | * | 7/1986 | Halberstadt et al. | 219/459.1 |
| 4,678,959 | A | * | 7/1987 | Mewissen | 313/17 |
| 4,710,677 | A | * | 12/1987 | Halberstadt et al. | 313/580 |
| 4,728,763 | A | * | 3/1988 | Bell et al. | 219/685 |
| 4,728,777 | A | * | 3/1988 | Tsisios et al. | 392/418 |
| 4,771,154 | A | * | 9/1988 | Bell et al. | 219/685 |

(Continued)

FOREIGN PATENT DOCUMENTS

DE 4211163 A1 9/1993

(Continued)

*Primary Examiner* — Mariceli Santiago
*Assistant Examiner* — Glenn Zimmerman
(74) *Attorney, Agent, or Firm* — Volentine & Whitt, PLLC

(57) ABSTRACT

The present invention relates to a lamp assembly comprising a lamp (10) having a lamp vessel (101) with a longitudinal axis (CC). The lamp assembly comprises a support member (11) comprising a bottom surface (111) extending substantially along the longitudinal axis. Between the bottom surface and the lamp vessel, a reflective member (12) is supported by the support member and has a surface comprising a material with a melting temperature higher than 600° C.

14 Claims, 8 Drawing Sheets

U.S. PATENT DOCUMENTS

| | | | | | |
|---|---|---|---|---|---|
| 4,857,709 | A | * | 8/1989 | Janssen et al. | 219/459.1 |
| 4,864,104 | A | * | 9/1989 | Crossley et al. | 219/462.1 |
| 4,868,371 | A | * | 9/1989 | Crossley et al. | 219/448.17 |
| 4,892,997 | A | * | 1/1990 | McWilliams | 219/448.11 |
| 4,900,899 | A | * | 2/1990 | Schreder et al. | 219/448.11 |
| 4,939,629 | A | | 7/1990 | Glanton et al. | |
| 5,054,889 | A | * | 10/1991 | Imanishi et al. | 349/123 |
| 5,132,519 | A | * | 7/1992 | Jackson et al. | 219/388 |
| 5,381,322 | A | * | 1/1995 | Humphreys | 362/220 |
| 5,387,800 | A | | 2/1995 | Kurtich et al. | |
| 5,757,112 | A | * | 5/1998 | Van Dulmen | 313/113 |
| 5,946,364 | A | * | 8/1999 | Marlowe | 376/245 |
| 6,074,771 | A | * | 6/2000 | Cubukcu et al. | 429/434 |
| 6,093,919 | A | * | 7/2000 | Seo et al. | 219/685 |
| 6,145,547 | A | * | 11/2000 | Villatte | 138/149 |
| 6,351,602 | B1 | | 2/2002 | Chaney et al. | |
| 6,393,211 | B1 | | 5/2002 | Jolan et al. | |
| 6,435,696 | B1 | * | 8/2002 | Foottit | 362/219 |

FOREIGN PATENT DOCUMENTS

| | | | |
|---|---|---|---|
| DE | 10145650 | A1 | 4/2003 |
| EP | 345890 | A1 | 12/1989 |
| FR | 2747455 | A3 | 10/1997 |
| JP | 63016542 | | 1/1988 |
| JP | 09326206 | | 12/1997 |
| JP | 2000139727 | | 5/2000 |
| WO | 2004049760 | A1 | 6/2004 |

* cited by examiner

AA

LAMP ASSEMBLY WITH LAMP AND REFLECTOR

FIELD OF THE INVENTION

The present invention relates to a lamp assembly comprising a lamp with a reflector.

The present invention also relates to a heating system comprising at least one lamp assembly.

The invention finds its application, for example, in a heating system designed for industrial purposes such as curing of synthetic resins by heat, drying of paper, baking of paints or heating plastic performs.

BACKGROUND OF THE INVENTION

Patent application WO2004/049760 describes a lamp assembly comprising a lamp and a reflector. The reflector aims at avoiding loss of radiation and focusing the radiation emitted by the lamp on a desired point. The lamp is maintained in position with respect to the reflector by means of two supports, which are attached to the reflector. This lamp assembly is intended to be put in a heating system.

However, such a lamp assembly is bulky. As a consequence, it is not adapted for many heating systems. In particular, such a lamp assembly cannot be adapted in a furnace comprising means for receiving the ends of lamps. Such furnaces comprise reflectors and supports for receiving lamps. However, the shape of the reflectors is pre-determined, because the reflectors are already present in the furnace. For example, the furnace may comprise reflecting walls. Hence, these furnaces may not be adapted for certain applications. If, for instance, the furnace has been designed for drying flat surfaces, it may not be adapted for heating bottles preforms. As a consequence, it would be advantageous if a lamp assembly comprising a lamp and a reflector could be placed in such a furnace, because the shape of the reflector can be chosen independently of the furnace. Unfortunately, the lamp assembly of WO2004/049760 is too bulky and thus cannot be placed in such a furnace.

Moreover, the size of the lamp assembly of WO2004/049760 can hardly be reduced. Actually, a reduction of the size of this lamp assembly would lead to a short distance between the lamp and the reflector. As the temperature of the lamp vessel is relatively high, it would deteriorate the reflector unless using a supplementary cooling air or water system.

SUMMARY OF THE INVENTION

It is an object of the invention to provide a lamp assembly comprising a lamp and a reflector, which lamp assembly is more compact.

To this end, the invention proposes a lamp assembly comprising a lamp with a lamp vessel comprising a longitudinal axis, the lamp assembly further comprising a support member comprising a bottom surface extending substantially along said longitudinal axis and, between the bottom surface and the lamp vessel, a reflective member supported by the support member and having a surface comprising a material with a melting temperature higher than 600° C.

Such a material can withstand relatively high temperatures. As a consequence, it can be placed close to the lamp, which makes the lamp assembly more compact. The reflective member can be given any shape, so that such a lamp assembly will be well adapted for many different applications, where different shapes of reflectors are needed. In particular, the shape of the reflective part is not commanded by the heating system nor by the shape of the lamp. The support member protects the reflective part, which is advantageous because such a material is relatively fragile. Hence, the lamp assembly can be made relatively compact. In particular, it can be made such that its dimensions are close to the dimensions of the lamp. Such a lamp assembly can be placed instead of a lamp in a furnace intended to receive lamps.

Advantageously, the support member further comprises two closing surfaces substantially perpendicular to the longitudinal axis, each closing surface having a slot in which an end of the lamp is inserted. Such a support member is relatively easy to manufacture, and the assembly process of the lamp assembly is relatively easy. Moreover these two closing surfaces constitute an additional protection for lamp pinches against the lamp radiation.

Preferably, the support member further comprises two lateral surfaces substantially perpendicular to the bottom surface and parallel to the longitudinal axis. The reflective member may be maintained inside the support member by means of the lateral surfaces. Hence, no additional means for fixing the reflective member are needed.

Advantageously, the lateral surfaces are designed in such a way that the lamp vessel is completely inside the support member. This avoids that an object under heating touches the lamp vessel, which would deteriorate said object.

Preferably, a cap is mounted at an end of the lamp and the support member is fixed to said cap. This simplifies the assembly process of the lamp assembly. Actually, the support member can be mechanically fixed to the caps of the lamp, which avoids additional means for maintaining the lamp in the lamp assembly.

The invention also relates to a heating system comprising at least one such lamp assembly.

These and other aspects of the invention will be apparent from and will be elucidated with reference to the embodiments described hereinafter.

BRIEF DESCRIPTION OF THE DRAWINGS

The present invention will now be described in more detail, by way of example, with reference to the accompanying drawings, wherein.

DETAILED DESCRIPTION OF THE INVENTION

Figure 1A:
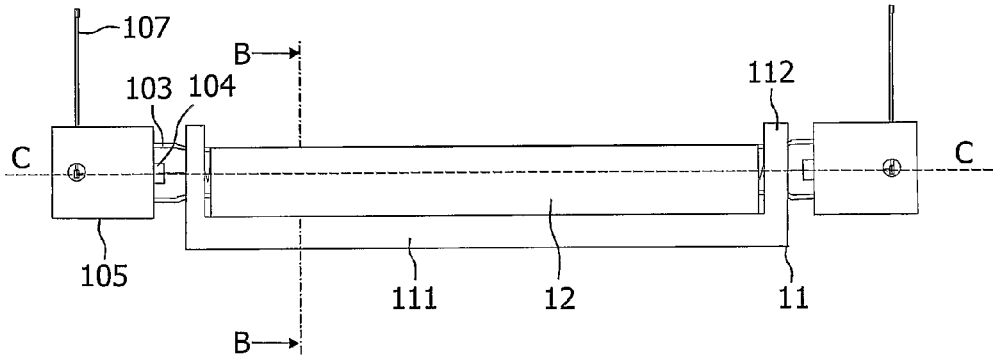
Fig. 1*a* shows a side view of a lamp assembly in accordance with a first embodiment of the invention.
Figure 1B:
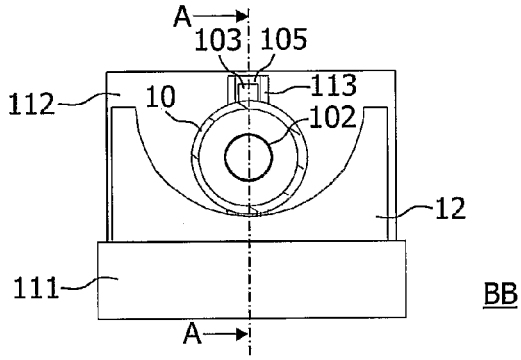
FIG. 1*b* shows a cross section in a plane BB of FIG. l*a*.
Figure 1C:
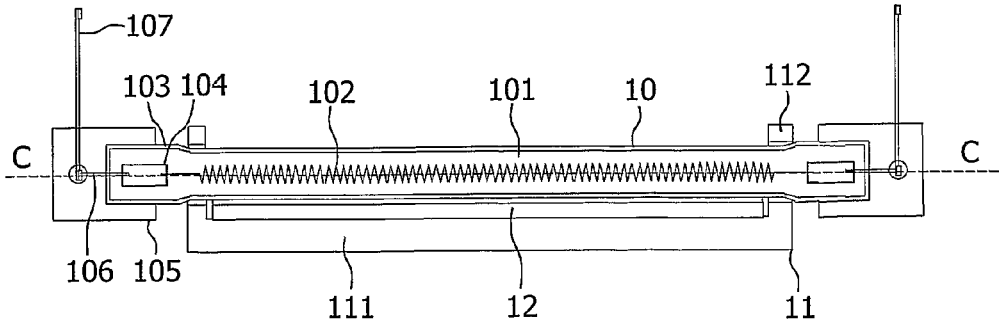
FIG. 1*c* shows a cross section in a plane AA of FIG. 1*b*, FIG. l*d* is an exploded perspective view of the lamp assembly of FIGS. l*a* to l*c* and FIG. l*e* is a perspective view of said lamp assembly.
Figure 1D:
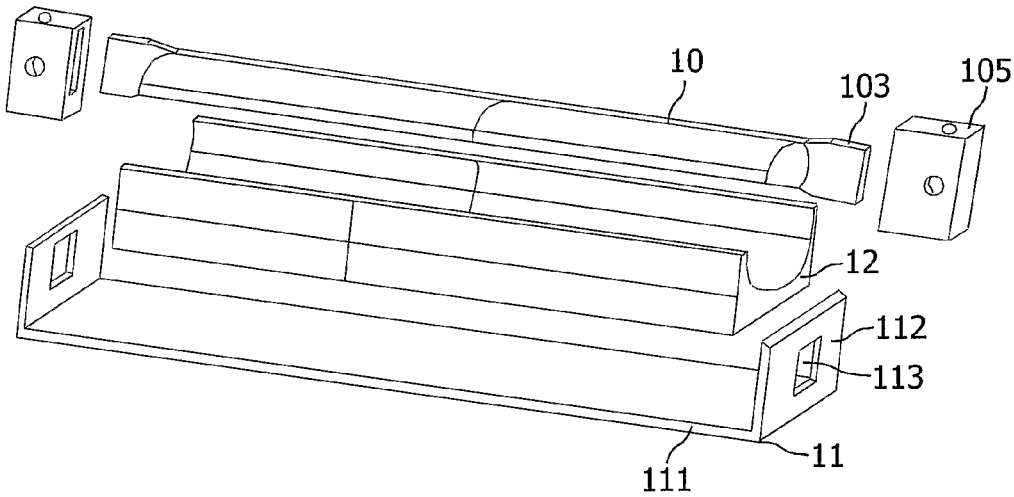
Figure 1E:
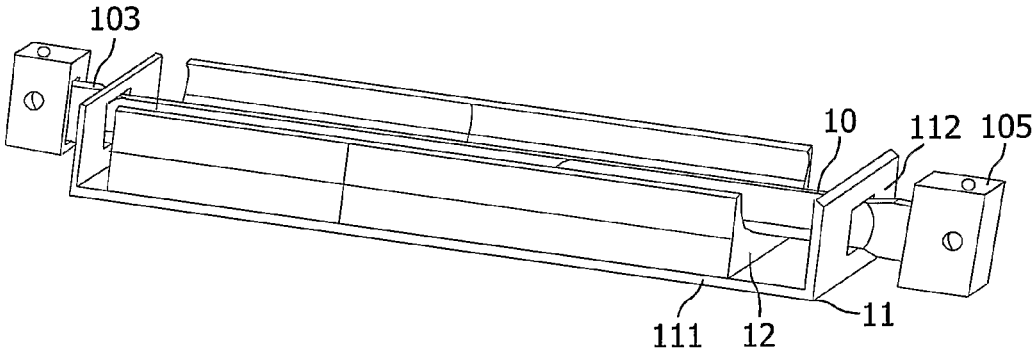

A lamp assembly in accordance with a first embodiment of the invention is depicted in FIGS. 1*a* to 1*c* and in FIG. 1*d* to 1*e*. FIG. 1*a* is a side view of said lamp assembly. FIG. 1*b* is an enlarged cross-section in the plane BB of FIG. 1*a*. FIG. 1*c* is a cross section in the plane AA of FIG. 1*b*. FIG. 1*d* is an exploded view of the lamp assembly and FIG. 1*e* is a perspective view of this lamp assembly. For reasons of convenience, the respective dimensions of the elements of the lamp may not correspond in the Figs. This lamp assembly comprises a lamp 10, a support member 11 and a reflective member 12. The lamp extends along a longitudinal axis CC and comprises a lamp vessel 101, an incandescent body 102 and current supply conductors 106. The lamp further comprises caps 105, foils 104 and current wires 107. Although a double-ended lamp has been represented in the Figs., the invention may be applied to a single-ended lamp. In the example of FIGS. 1*a* to 1*e*, the lamp comprises two ends 103.

The incandescent body 102, which is for example a tungsten wire, has its extremities connected to the foils 104, which are for example pieces of molybdenum to which the extremities of the incandescent body 102 are welded. Current supply conductors 106 are also welded to the foils 104. The current supply conductors 106 are connected to the current wires 107. This can be done by welding a current supply conductor 106 to a current wire 107, through a hole of a cap 105. Such a cap 105 is described in patent EP 0345890. Alternatively, the extremity of the incandescent body 102 serves as current supply conductor and is directly connected to the current wire 106. The lamp vessel 101 is filled with a high-pressure discharge gas, such as argon, and comprises a small quantity of a halide substance in order to prevent darkening, due to deposition of gaseous tungsten.

The support member 11 here comprises a bottom surface 111, which extends along the longitudinal axis CC. The bottom surface 111 may not be exactly parallel to the longitudinal axis CC, but extends substantially along said longitudinal axis CC, which means that the main direction of the bottom surface 111 and the longitudinal axis CC make an angle that is preferably inferior to 30 degrees, more preferably inferior to 10 degrees. The support member 11 further comprises two closing surfaces 112, which each comprises a slot 113.

During assembling process of this lamp assembly, the reflective member 12 is positioned on the bottom surface 111 of the support member 11. The reflective member 12 may be fixed to the bottom surface 111, for example by means of cement. However, it is possible to position the reflective member 12 in the lamp assembly without fixing it to the support member 11. For example, the reflective member 12 may be maintained in position in the lamp assembly by means of the lamp 10, as will be explained later on. Then the ends 103 of the lamp 10 are inserted in the slots 113 of the support member 11, and finally the caps 105 are mounted at each end 103 of the lamp 10.

In the example of FIGS. 1*a* to 1*e*, the support member 11 is a one-part mechanical piece. Such a one-part piece is easy to manufacture. For example, it can be manufactured by bending a metallic longitudinal piece so as to obtain the closing surfaces 112, and by making a hole in each closing surface 112 so as to obtain the slots 113. As a consequence, the cost of the lamp assembly is reduced, as well as the time needed for manufacturing this lamp assembly.

The lamp 10 may be fixed to the support member 11, for instance by means of cement. Alternatively, the caps 105 may be fixed to the support member 11, for instance by means of cement. However, it is possible to position the lamp 10 in the lamp assembly without fixing it to the support member 11. Actually, in the example of FIGS. 1*a* to 1*e*, the lamp 10 is maintained in position in the lamp assembly, because the closing surfaces 112 and the caps 105 avoids that the lamp 10 exits the lamp assembly.

The dimensions of the lamp 10, the support member 11 and the reflective member 12 may be such that the reflective member 12 is maintained in position in the lamp assembly without need to fix said reflective member 12 to either the support member 11 or the lamp 10. For example, the lamp vessel 101 may be in contact with the reflective member 12. This is possible, because the reflective surface of the reflective member 12 comprises a material, which can withstand the temperature of the lamp vessel 101 in operation.

Due to the temperature of such a lamp vessel in operation, the reflective material is chosen to resist to temperatures higher than 600° C., i.e. its melting temperature is higher than this limit. The reflective material is preferably chosen to have a high near infrared reflectivity. Preferably, the total near infrared reflectivity is higher than 85%. Then having a total near infrared reflectivity higher than 85% allows maintaining the reflective surface in its domain of temperature, despite the high thermal constraint applied by the lamp. This preserves the characteristics of the reflective material along the lamp lifetime.

Such materials are often used for embedded reflectors, such as described in patent U.S. Pat. No. 4,710,677. Such a material may be made of a high percentage, such as more than 20 percent, of aluminum oxide or silica oxide for example. However, an embedded reflector, which is coated on the lamp vessel, has the disadvantage that its shape is restricted to the shape of the external quartz lamp tube, often a cylindrical shape. Moreover the thickness of an embedded reflector is limited in order to maintain a high adherence. In the case of the invention, the thickness of the reflective surface may be increased.

The reflective member 12 may be integrally formed of this material. Alternatively, only the surface that is close to the lamp vessel 101 may be coated with such a material.

As a consequence, the reflective member 12 may be placed close to the lamp vessel 101. This makes such a lamp assembly relatively compact. Moreover, the reflective member 12 is supported by the support member 11. This allows the use of a fragile material for the reflective surface of the reflective member 12, which would not be possible without the support member 11. As the lamp assembly is compact, it can be placed in a heating system designed for receiving lamps. Such a heating system comprises supports for receiving the caps 105 of the lamp 10. Instead of inserting the lamp 10, the lamp assembly comprising the lamp 10, the reflective member 12 and the support member 11 may be inserted by inserting the caps 105 inside said supports. This is particularly advantageous, because the shape of the reflective member 12 may be chosen independently of the heating system. As a consequence, a same heating system can be used for different purposes that require different irradiations of the objects to be heated, and thus different shapes of the reflecting surfaces of the heating system.

FIGS. 2*a* to 2*e* show a lamp assembly in accordance with a second embodiment of the invention. In this second embodiment, the support member 11 further comprises two lateral surfaces 114. The support member 11 in this case is an open box in which two holes have been made in order to make the two slots 113. Such a support member 11 is thus particularly easy to manufacture.

In the example of FIGS. 2*a* to 2*e*, the dimensions of the support member 11 are such that the lamp vessel 101 is completely inside said support member 11. As a consequence, the lamp vessel 101 is protected by the support member 11. This is particularly advantageous, in particular when the lamp assembly is used in a heating system in which the objects under treatment can move. This is the case, for example, in heating systems used for forming bottle performs. In these heating systems, an object under treatment may touch the lamp vessel 101. This may alter this object, or even alter the lamp vessel 101. This is not possible when a lamp assembly such as described in FIGS. 2*a* to 2*e* is used in the heating system, because the lateral surfaces avoid that an object touches the lamp vessel 101.

The lateral surfaces 114 are also particularly advantageous, because they protect the reflective member 112. Moreover, the support member 11 may be designed in such a way that the lateral surfaces 114 tightly enclose the reflective member 12. In this case, the reflective member 12 is maintained in position in the lamp assembly by means of the lateral surfaces.

Figure 2A:
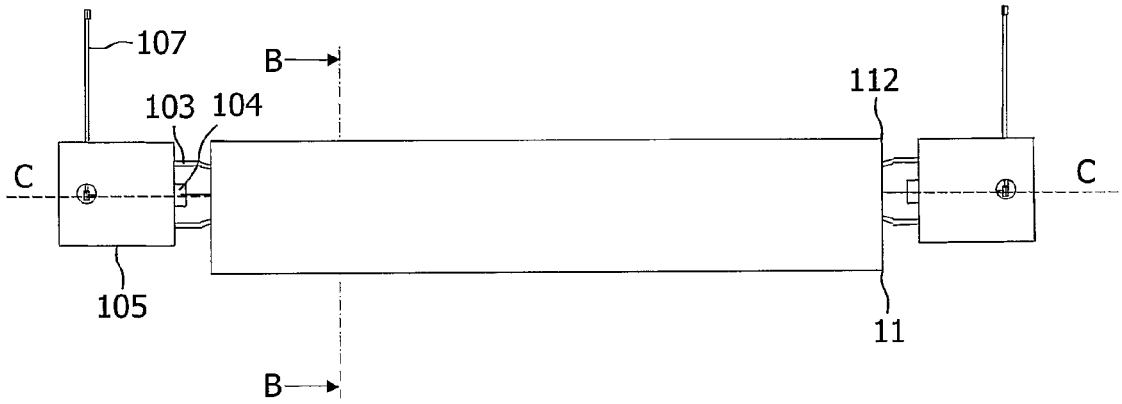
FIG. 2*a* shows a side view of a lamp assembly in accordance with a second embodiment of the invention.
Figure 2B:
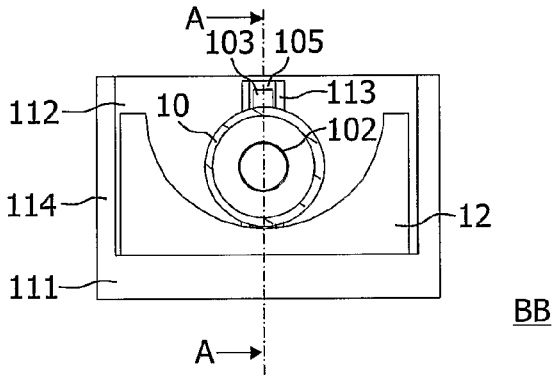
FIG. 2*b* shows a cross section in a plane BB of FIG. 2*a*.
Figure 2C:
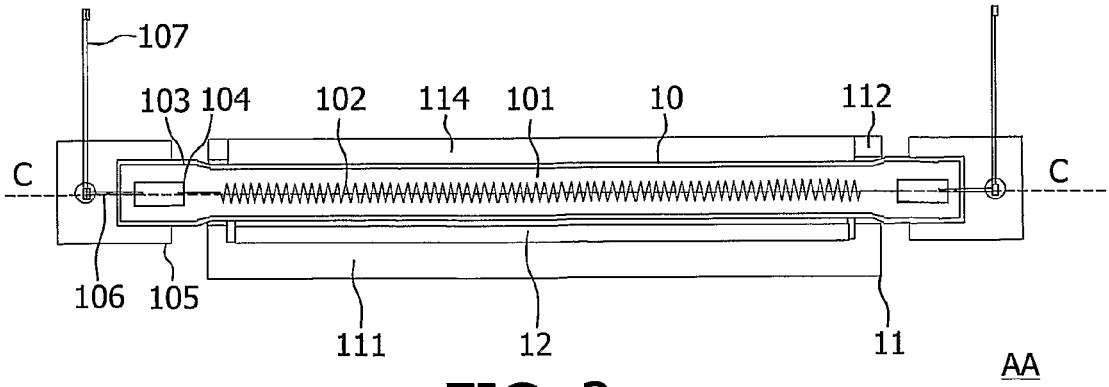
FIG. 2*c* shows a cross section in a plane AA of FIG. 2*b*.
Figure 2D:
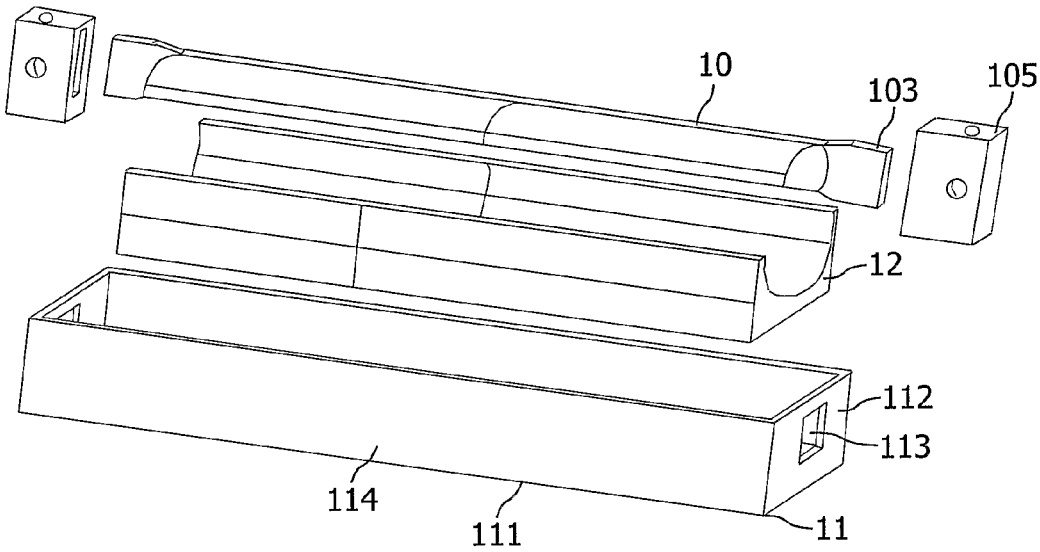
FIG. 2*d* is an exploded perspective view of the lamp assembly of FIGS. 2*a* to 2*c*.
Figure 2E:
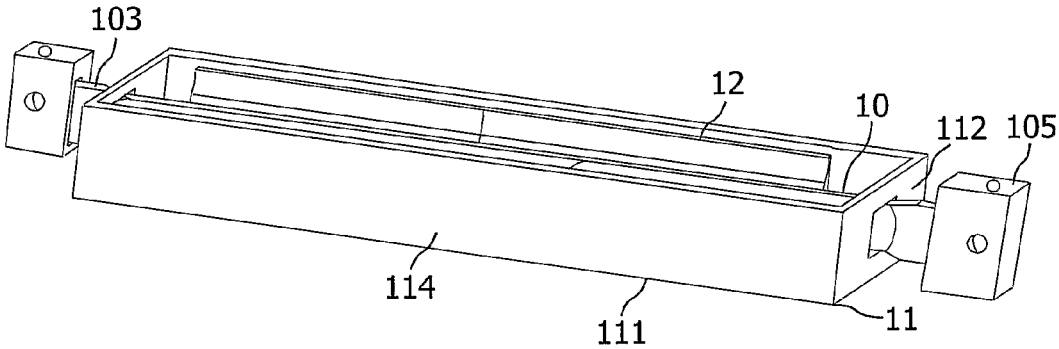
FIG. 2*e* is a perspective view of said lamp assembly and FIG. 2*f* is a variant of the support member in accordance with this second embodiment.
Figure 2F:
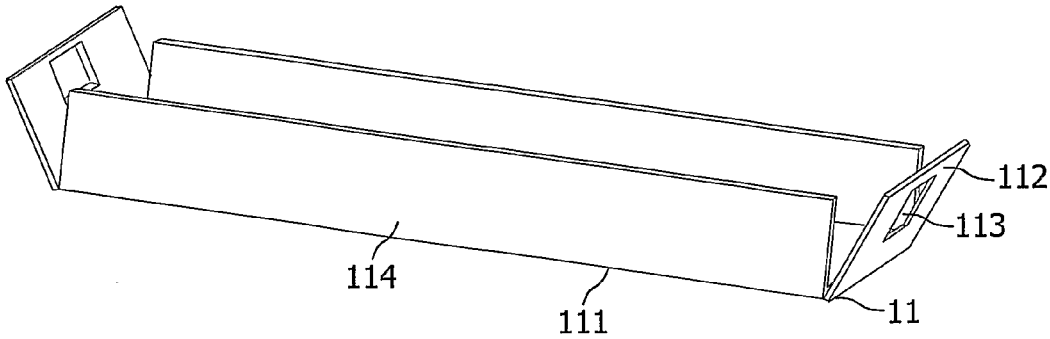

In FIG. 2*f*, a variant of the support member of FIG. 2*d* is shown. In this variant, the closing surfaces 112 can move with respect to the lateral surfaces 114. This makes the assembling process of the lamp assembly easier, because insertion of the ends 103 of the lamp 10 in the slots 113 is easier. This can be achieved, for example, in that the support member 11 of FIG. 2*d* is partially cut so that the lateral surfaces 112 can rotate around an axis that is perpendicular to the lateral surfaces 114.

Figure 3A:
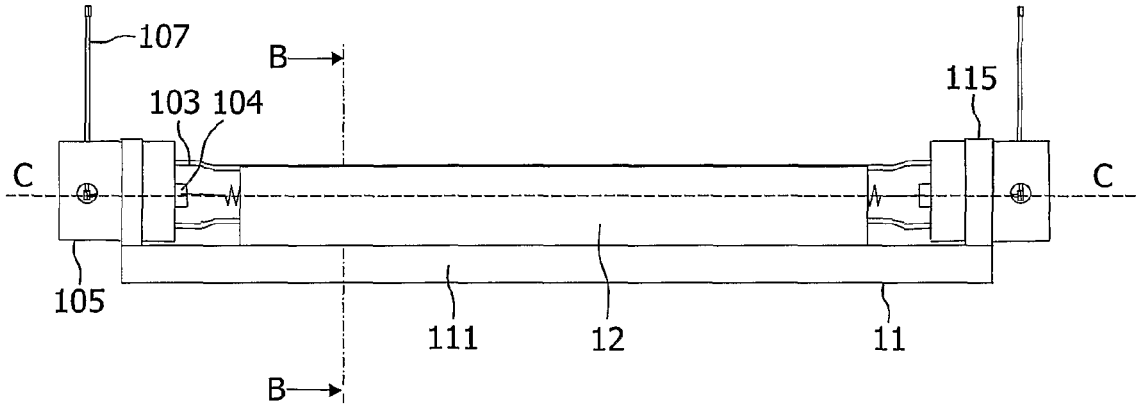
FIG. 3*a* shows a side view of a lamp assembly in accordance with a third embodiment of the invention.
Figure 3B:
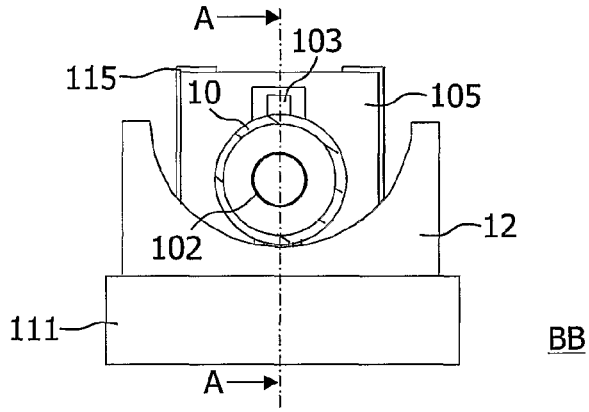
FIG. 3*b* shows a cross section in a plane BB of FIG. 3*a*.
Figure 3C:
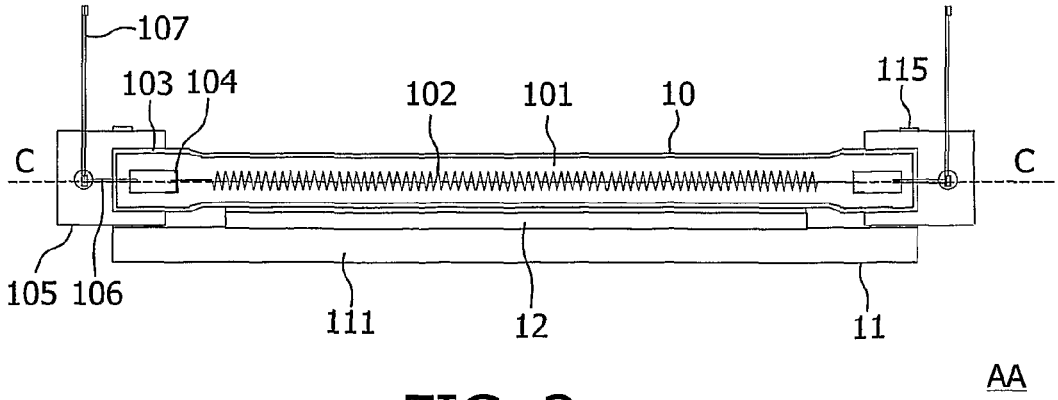
FIG. 3*c* shows a cross section in a plane AA of FIG. 3*b*.
Figure 3D:
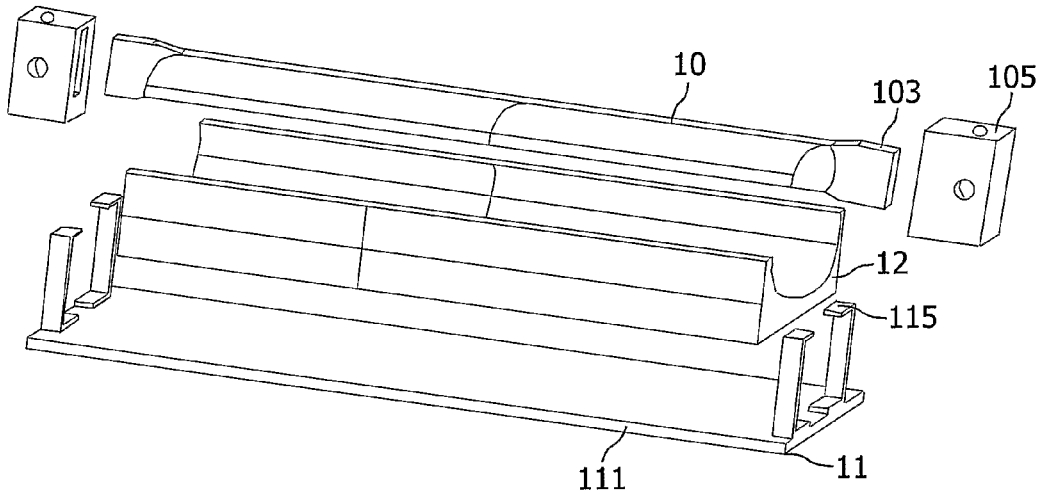
FIG. 3*d* is an exploded perspective view of the lamp assembly of FIGS. 3*a* to 3*c* and FIG. 3*e* is a perspective view of said lamp assembly.
Figure 3E:
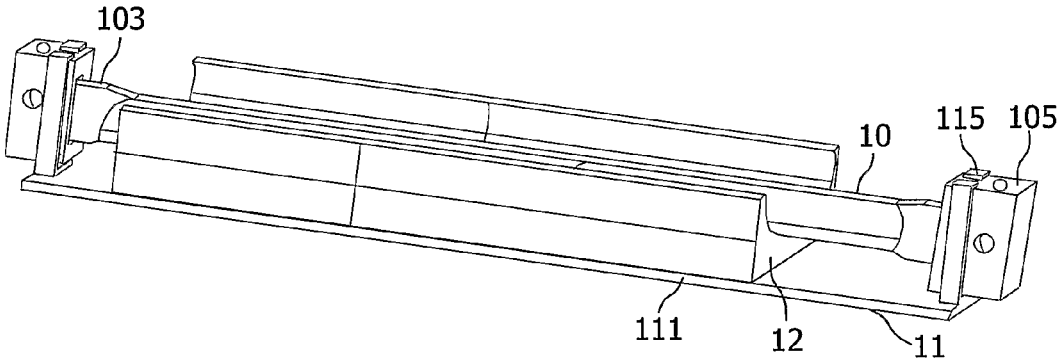

A lamp assembly in accordance with a third embodiment of the invention is depicted in FIGS. 3*a* to 3*e*. In this embodiment, the support member 11 comprises the bottom surface 111 and hooks 115. As shown in FIGS. 3*d* and 3*e*, the assembling process is the following. First, the caps 105 are mounted at each end of the lamp 10. Then, the reflective member 12 is mounted on the support member 11, and may possibly be fixed to the bottom surface 111, for instance by means of cement. Then, the caps 105 are inserted in the hooks 115. The hooks 105 maintain the lamp 10 in position in the lamp assembly. As a consequence, no additional means for fixing the lamp 10 in the lamp assembly are required.

It should be noted that the caps 105 and the support member 11 may be one and the same element. This reduces the number of elements in the lamp assembly, and thus decreases the cost of the lamp assembly as well as the time needed for assembling said lamp assembly. In this case, the reflective member 12 is first mounted on the support member 11, and then the ends of the lamp 10 are inserted in the caps 105, which form part of the support member 11.

Figure 4A:
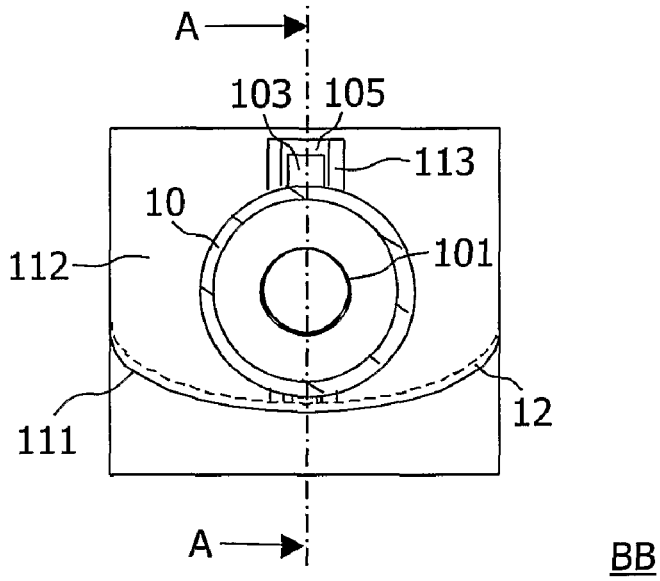
FIGS. 4*a* and 4*b* show other embodiments of the lamp assembly in accordance with the invention.
Figure 4B:
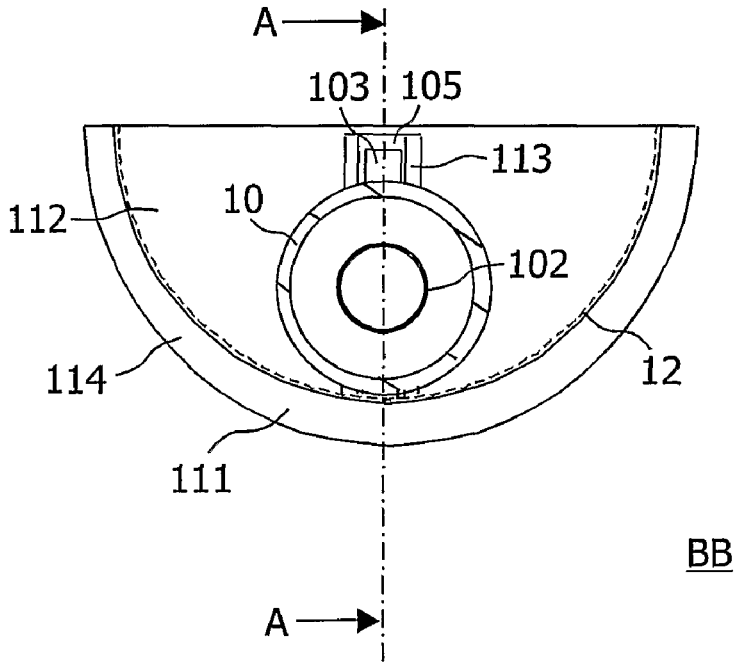

Although the reflective member 12 has been represented as a thick element, the reflective member 12 may comprise only a reflective surface. Examples of lamp assemblies where the reflective member 12 is a reflector coated on the support member 11 are given in FIGS. 4*a* and 4*b*. FIGS. 4*a* and 4*b* are cross sections of lamp assemblies in a plane perpendicular to the longitudinal axis CC. In FIG. 4*a*, the reflective member 12 is a reflective coating that is coated on a concave bottom surface 111 of the support member 11. The support member comprises closing surfaces 112, as described in FIGS. 1*a* to 1*e*. The shape of the concave surface of the support member 11 can be chosen as a function of the application of the lamp assembly in a heating system. This shape does not depend on the shape of the lamp 10, nor on the heating system in which the lamp assembly is intended to be used.

In FIG. 4*b*, the reflective member 12 is also a reflective coating that is coated on a concave bottom surface 111 of the support member 11. In this example, the bottom surface 111 of the support member 11 is a semi-cylinder, which also comprises the lateral surfaces 114 of the support member 11.

Figure 5:
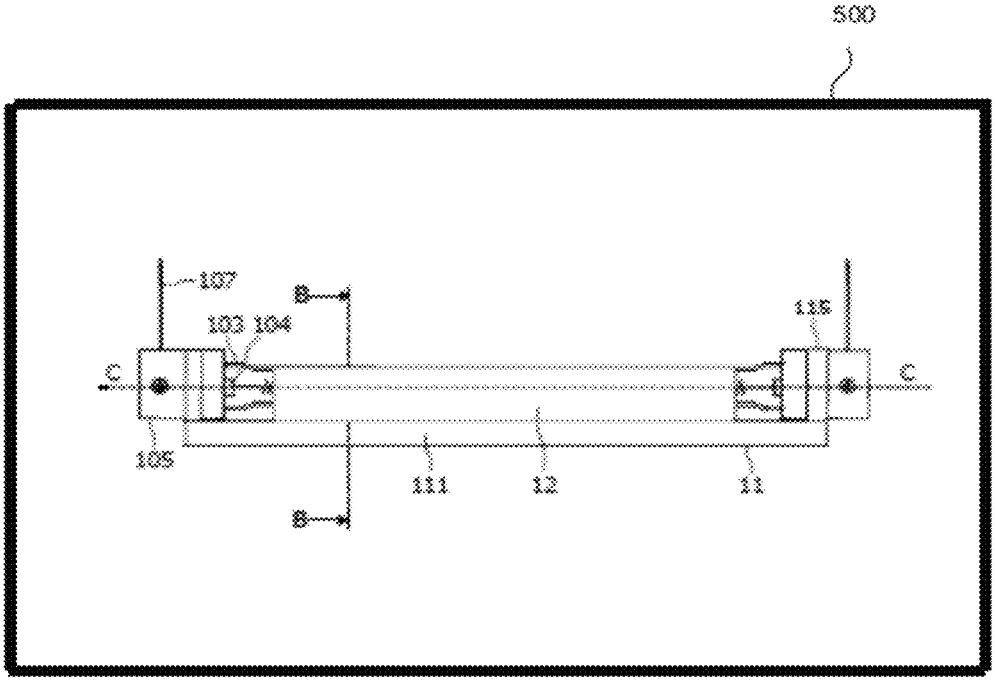
FIG. 5 shows a lamp assembly placed in a furnace.

FIG. 5 shows a lamp assembly placed in a furnace 500.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A system, comprising:

a furnace; and at least one lamp assembly disposed within the furnace, the at least one lamp assembly comprising:

a lamp comprising a lamp vessel having two pinched ends, wherein the lamp vessel extends in a longitudinal direction between the two pinched ends;

a monolithic support member comprising a bottom surface extending in the longitudinal direction;

a reflective member supported by the monolithic support member and having a first dimension in the longitudinal direction, wherein the reflective member has a surface comprising a material with a melting temperature higher than 600° C., wherein the reflective member is disposed between the lamp vessel and the bottom surface of the monolithic support member, and wherein the reflective member encloses the lamp vessel on three sides thereof extending in the longitudinal direction between the pinched ends of the lamp vessel, and wherein the reflective member does not enclose the lamp vessel along a fourth side thereof extending in the longitudinal direction and opposite the bottom surface of the monolithic support member, and wherein the monolithic support member supports, and is in direct contact with, the pinched ends of the lamp.

2. A system of claim 1, the monolithic support member further comprising at least one closing surface substantially perpendicular to the longitudinal axis, said closing surface having a slot in which an end of the lamp is inserted.

3. A system of claim 1, the monolithic support member further comprising two lateral surfaces substantially perpendicular to the bottom surface and parallel to the longitudinal axis.

4. A system of claim 1, wherein the reflective member is fixed to the monolithic support member by means of cement.

5. A system of claim 1, wherein the lamp further comprises caps mounted on the pinched ends of the lamp vessel, and wherein the monolithic support member is fixed to said caps.

6. The system of claim 1, wherein the material is a ceramic material.

7. The system of claim 6, wherein the ceramic material comprises a proportion of aluminum oxide or silica oxide that is larger than 20 percent.

8. The system of claim 1, wherein the reflective member contacts the lamp vessel.

9. The system of claim 1, wherein the lamp further comprises caps mounted on the pinched ends of the lamp vessel, and wherein the caps are disposed completely outside of the monolithic support member.

10. The system of claim 1, wherein the lamp further comprises caps mounted on the pinched ends of the lamp vessel, wherein the monolithic support member further comprises a pair of hooks that extend from the bottom surface substantially perpendicularly to the bottom surface, and wherein the caps are disposed within the hooks.

11. The system of claim 1, wherein the lamp further comprises caps mounted on the pinched ends of the lamp vessel, wherein the monolithic support member has a second dimension in the longitudinal direction, and wherein a distance between the caps is greater than the second dimension.

12. The system of claim 1, wherein the reflective member is integrally formed of the material with the melting temperature higher than 600° C.

13. The system of claim 1, wherein the reflective member has a total near infrared reflectivity greater than 85%.

14. The system of claim 1, wherein a distance between the pinched ends of the lamp vessel is greater than the first dimension of the reflective member in the longitudinal direction.

* * * * *